United States Patent [19]

Caillat

[11] Patent Number: 4,781,549

[45] Date of Patent: Nov. 1, 1988

[54] MODIFIED WRAP SCROLL-TYPE MACHINE

[75] Inventor: Jean-Luc Caillat, Dublin, Ohio

[73] Assignee: Copeland Corporation, Sidney, Ohio

[21] Appl. No.: 52,107

[22] Filed: May 19, 1987

Related U.S. Application Data

[62] Division of Ser. No. 781,891, Sep. 30, 1985, abandoned.

[51] Int. Cl.[4] ..... F01C 1/04; F01C 21/04; F01C 21/08

[52] U.S. Cl. ..... 418/55; 418/97; 418/150

[58] Field of Search ..... 418/55, 97, 150, 189

[56] References Cited

U.S. PATENT DOCUMENTS

| | | | |
|---|---|---|---|
| 3,473,728 | 10/1969 | Vulliez | 418/55 |
| 3,802,809 | 4/1974 | Vulliez | 418/55 |
| 3,874,827 | 4/1975 | Young . | |
| 4,417,863 | 11/1983 | Ikegawa et al. | 418/55 |
| 4,441,870 | 4/1984 | Ikegawa et al. . | |
| 4,540,355 | 9/1985 | Sakaki et al. . | |
| 4,547,137 | 10/1985 | Terauchi et al. | 418/55 |
| 4,552,517 | 11/1985 | Shimizu | 418/55 |
| 4,558,997 | 12/1985 | Sakata et al. | 418/55 |
| 4,594,061 | 6/1986 | Terauchi | 418/55 |

FOREIGN PATENT DOCUMENTS

| | | | |
|---|---|---|---|
| 0061065 | 9/1982 | European Pat. Off. . | |
| 0122722 | 10/1984 | European Pat. Off. . | |
| 848889 | 8/1939 | France | 418/55 |
| 58-62397 | 4/1983 | Japan | 418/55 |
| 58-101285 | 6/1983 | Japan . | |
| 58-135393 | 8/1983 | Japan | 418/55 |
| 58-170879 | 10/1983 | Japan | 418/97 |
| 59-99085 | 6/1984 | Japan | 418/55 |
| 220296 | 1/1925 | United Kingdom . | |

*Primary Examiner*—John J. Vrablik

*Attorney, Agent, or Firm*—Harness, Dickey & Pierce

[57] ABSTRACT

There is disclosed a scroll-type machine suited for use as a gaseous fluid compressor. The machine incorporates symmetrical scroll members of substantially one wrap that have modified inner ends to provide continued sealing to a single separation point. The one wrap configuration and modified ends provide a very compact compressor design that enhances manufacturability and yet is able to deliver fluid gas with much greater pressure ratio versatility than conventional multi-wrap scroll compressors. The machine incorporates a discharge valve in the discharge port that allows various pressure ratios to be attained for a variety of end uses.

28 Claims, 6 Drawing Sheets

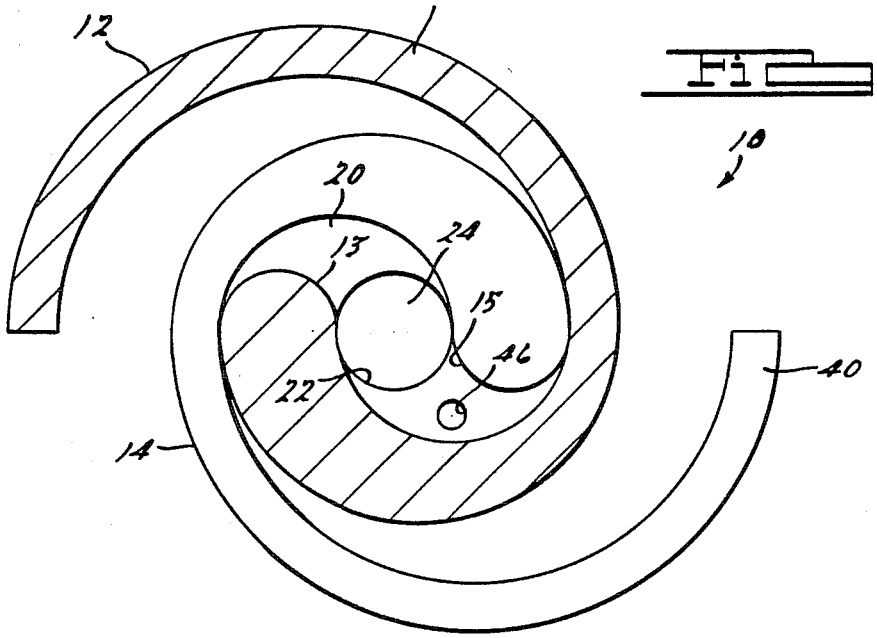
FIG. 4.
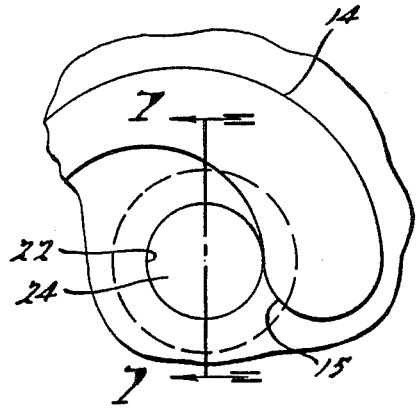
FIG. 6.
FIG. 5.
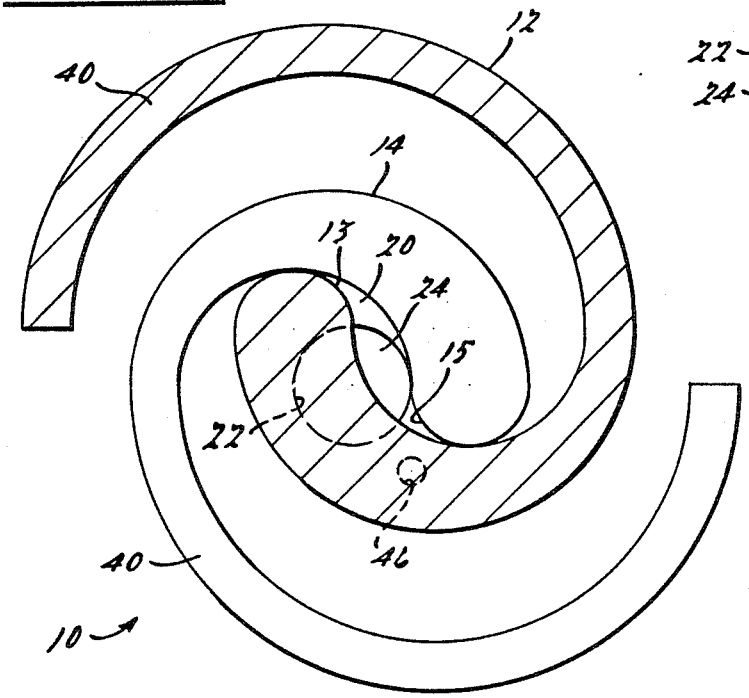
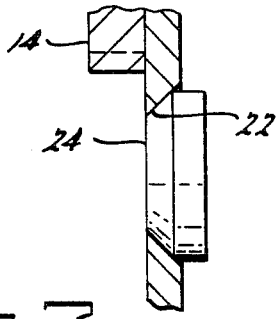
FIG. 7.

MODIFIED WRAP SCROLL-TYPE MACHINE

This is a divisional of U.S. patent application Ser. No. 781,891, filed Sept. 30, 1985 entitled "Modified Wrap Scroll Type Machine", now abandoned.

BACKGROUND AND SUMMARY

The present invention relates to fluid displacement apparatus and more particularly to an improved scroll-type machine especially adapted for compressing gaseous fluids and having modified scroll means to provide increased speed of operation, improved efficiency, and a more compact design thus improving overall manufacturability of the apparatus.

A class of machines exists in the art generally known as "scroll" apparatus for the displacement of various types of fluids. Such apparatus may be configured as an expander, a displacement engine, a pump, a compressor, etc. The present invention, however, while useful in basic design as a pump, is particularly applicable to compressors, and therefore for purposes of illustration is disclosed in the form of a gaseous fluid compressor.

Generally speaking, a conventional scroll apparatus comprises two spiral scroll wraps of symmetrical configuration each mounted on a separate parallel end or base plate to define a scroll member. In known scroll-type machines, the two scroll members are interfitted together with the wraps of one of the scroll members being rotationally displaced 180 degrees from the other. The apparatus generally operates by orbiting one scroll member (the "orbiting scroll") with respect to the other scroll member (the "fixed scroll") to create moving line contacts between the flanks of the respective wraps and define moving isolated crescent-shaped pockets or chambers of fluid. In practice, the orbiting scroll may be driven by the drive shaft, i.e. crank, or caused to orbit through the use of any other suitable known drive mechanism means. It is also known to rotate both scroll members with respect to one another as disclosed in U.S. Pat. No. 4,178,143.

The scroll members of the conventional scroll apparatus have spiral profiles which are commonly formed as involutes of a circle or other suitable geometric figure, and there is typically no relative rotation between the symmtrical scroll members during operation, i.e., the motion is purely curvilinear translation. The two scrolls are maintained in such substantially fixed angular relationship with respect to one another by an oldham coupling or the like, or are allowed to undergo some minimal rotation with resect to one another through utilization of an anti-rotational link (as shown and described in U.S. Pat. No. 4,609,334, filed Mar. 3, 1983 for Scroll-Type Machine). The fluid pockets carry the fluid to be handled from a first zone in the conventional scroll apparatus where a fluid inlet is provided, to a second zone in the center of the apparatus where a normally open fluid outlet or discharge port is provided. The volume of a sealed pocket progressively changes as it moves from the first zone to the second zone (in a compressor the sealed pockets progressively decrease in volume). Typically, there will be at least one pair of opposed symmetrical sealed pockets, and when the scroll members each comprise multiple wraps, as in a conventional scroll apparatus for compressing fluids there are several pairs of opposed symmetrical sealed pockets at any one instant in time, each pair having a different volume. In a compressor the second zone is at a higher pressure than the first zone and is physically located centrally in the apparatus, the first zone being located at the outer periphery of the apparatus.

Generally, the greater the arcuate length of a scroll wrap of constant thickness, the greater the total possible reduction in the volume of a fluid pocket as it moves to the second zone, i.e., the greater the possible volume ratio.

Two types of contacts define the fluid pockets formed between the scroll members: axially extending tangential line contacts between the spiral faces of the wraps caused by radial forces of the orbiting scroll mass ("flank sealing"), and area contacts between the plane edge surfaces (the "tips") of each wrap and the opposite end plate ("tip sealing") caused by axial forces. For high efficiency, good sealing must be achieved for both types of contacts. In a conventional scroll compressor, good flank sealing is crucial, but at the same time, the friction associated with flank sealing can have detrimental wear effects.

The concept of a scroll-type apparatus has been known for some time and has been recognized as having distinct advantages. For example, scroll machines have high isentropic and volumetric efficiency and also are relatively small and lightweight for a given capacity. They tend to be somewhat quieter and more vibration free than many other types of compressors because they do not use large reciprocating parts (i.e. pistons, connecting rods, etc.), and because all fluid flow is monotonic with simultaneous compression in plural opposed pockets. Such machines also tend to have high reliability and durability because of the relative few moving parts utilized, the relatively low velocity of movement between the scrolls, and a inherent forgiveness to fluid contamination.

A conventional scroll compressor is a positive displacement fixed volume-ratio machine; at the suction inlet a given volume of a gaseous fluid is conventionally sealed off into the pair of opposed symmetrical pockets and compressed to a final volume at which point the pair of opposed pockets opens to a constantly open discharge port and the gaseous fluid is discharged. Because the conventional scroll compressor has a fixed volume ratio, it also has a fixed pressure ratio. The pressure of the final compressed volume just prior to discharge, and for that matter all intermediate volumes between initial seal-off and the final compressed volume just prior to discharge, is determined substantially by two factors: (1) the pressure of the initial suction volume at seal-off, and (2) the volume reduction during compression. Thus, the pressure of the initial charge will rise to whatever pressure is dictated by the volume reduction during compression. A three to one volume reduction machine, for example, will increase the pressure of the gas at discharge substantially more than threefold (due in part to quasi-adiabatic processes) over the inlet pressure no matter what the load pressure requirements are.

In a scroll compressor utilizing a normally open discharge port, discharge of the compressed fluid occurs as soon as either or both of a pair of fluid pockets are exposed to the discharge port. For conventional scroll apparatus to achieve desirable levels of volume reduction and pressure increase, however, scrolls with multiple wraps are required, thus making the diameter of each scroll member, and hence the overall size of the apparatus, relatively large. The relatively large size of the conventional scroll apparatus translates into high material and manufacturing cost; the multiple wraps of conventional scrolls themselves requiring intricate machining to fabricate.

It is therefore an object of this invention to provide a scroll apparatus having scroll members with a minimum number of scroll wraps that effect sealing of one or more fluid pockets and yet achieve the volume reduction of conventional scroll compressors.

It is a further object of this invention to provide a scroll compressor apparatus that comprises scroll members of aproximately a single wrap, thus resulting in greatly reduced scroll member diameter and allowing the apparatus to be a compact structure design, thereby improving the overall manufacturability and cost of the apparatus.

A further object of the invention resides in the provision of a scroll compressor apparatus having modified inner wrap ends that effect continued flank sealing until a single flank separation point is reached.

A further object of the invention resides in the provision of a discharge valve that enables the apparatus to take a fluid at inlet suction pressure and discharge it at design pressure in substantially a single crank revolution.

A still further object of the invention resides in the provision of a scroll compressor apparatus utilizing a discharge port valve that controls the volume ratio and enables the apparatus to achieve much greater pressure ratio versatility than prior known scroll compressors.

It is a still further object of the invention to provide a scroll compressor apparatus having a greater duration of discharge than comparable reciprocating or rotary piston compressors.

Additional objects and features of the present invention will become apparent from the subsequent description and the appended claims taken in conjunction with the accompanying drawings.

BRIEF DESCRIPTION OF THE DRAWINGS

FIG. 4 is a diagrammatic illustration of a pair of mating scroll wraps constructed in accordance with the present invention at approximately 180 degrees of crank revolution.

FIG. 5 is a diagrammatic illustration of a pair of mating scroll wraps constructed in accordance with the present invention at approximately 270 degrees of crank revolution.

FIG. 6 is a diagrammatic illustration of a disc-like discharge valve utilized in the discharge port of the present invention.

FIG. 7 is a sectional view of the disc-like discharge valve taken along line 7—7 in FIG. 6.

DETAILED DESCRIPTION OF THE PREFERRED EMBODIMENT

The basic structure and principles of the operation of scroll apparatus have been presented in a number of previously issued patents and therefore are well known to those skilled in this art. Consequently, a detailed description of the structure and operation of such apparatus will not be repeated in discussing the present invention.

Figure 14:
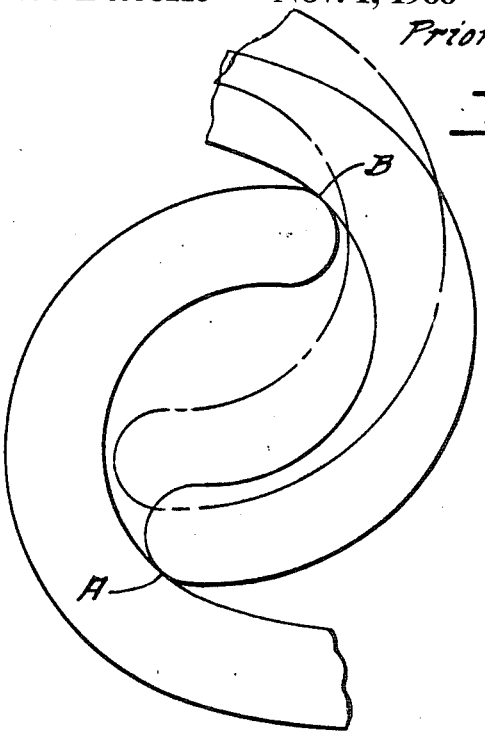
FIG. 14 is a diagrammatic illustration of the inner ends of a pair of conventional mating scroll wraps.

During the orbital operation of a conventional scroll compressor the outside face of the orbiting scroll wrap separates from the inside face of the fixed scroll wrap and the outside face of the fixed scroll wrap separates from the inside face of the orbiting scroll wrap at points of last sealing. When this separation occurs, and as it may occur under typical operating conditions where the external pressure ratio imposed by the receiver is not equal to the internal pressure ratio of the compressor, either the discharge gas is allowed to reexpand back into a pocket of fluid at lower pressure or the fluid of the pocket is throttled down to discharge pressure. That reexpansion or overcompression results in work loss and overall compression inefficiencies which are undesirable. These points of last sealing are shown in FIG. 14 and labeled A and B. Last sealing points A and B are defined respectively by (i) the separation point angle $\theta$ (in radians) and (ii) $\theta$ plus pi. After the points of last sealing are reached during the orbiting scroll's cycle, further revolution of the crank will cause the inner ends of the scroll members to separate (shown in phantom in FIG. 14).

The present invention comprises the discovery that by modifying the inner portions of the wrap profiles or flanks of the orbiting and fixed scrolls a sealing contour on the inside and outside of each of the inner wrap portions is provided so that the two points of last sealing are nonexistant and the wraps remain in contact until a last common sealing point is reached. (It is as if the two points had been moved toward each other to form only one.) This modification allows a pocket of fluid to undergo further compression if necessary and/or discharge. When a fluid pocket is further compressed the potential for increased pressure ratio is obtained over conventional design (with all other geometric variables being the same).

Referring now to the drawings, FIGS. 1 through 5 show a pair of mating scroll members of a scroll apparatus 10 of the present invention at various crank positions. Scroll apparatus 10 has an orbiting scroll 12 with an inner end 13 and a fixed scroll 14 with an inner end 15. Orbiting and fixed scrolls 12 and 14 are symmetrical and have a wrap length within a range of approximately 340 degrees to approximately 380 degrees, i.e. approximately one complete wrap. Wrap length is the arc inscribed by the wrap between the physical inner and outer ends of the scroll wrap.

Figure 1:
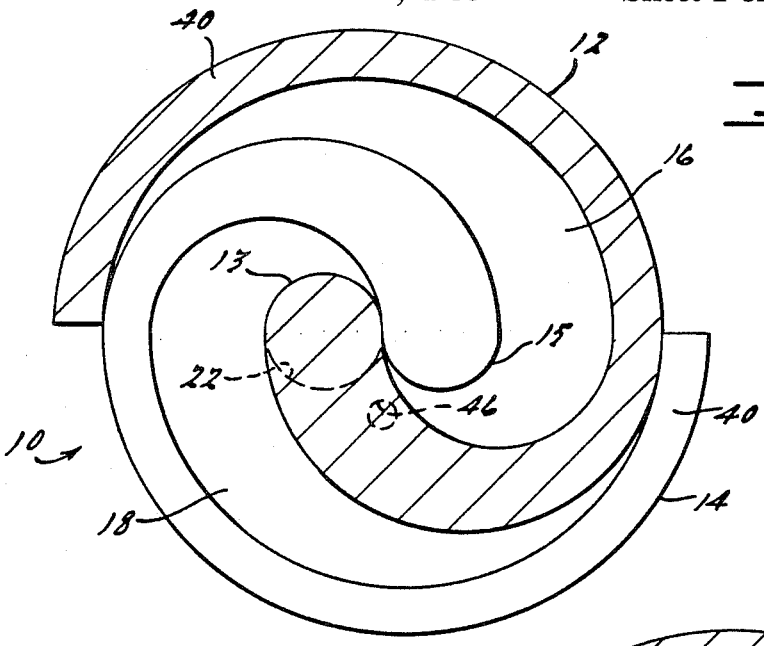
FIG. 1 is a diagrammatic illustration of a pair of mating scroll wraps constructed in accordance with the present invention at 0 degrees of crank revolution.

As shown in FIG. 1, a pair of opposed fluid pockets 16 and 18 are defined. Pockets 16 and 18 are bounded radially by three line contacts between the wraps of orbiting and fixed scrolls 12 and 14. The fluid is taken through the usual inlet or suction line (not shown) into a peripheral zone surrounding the wraps, and from there is introduced into pockets 16 and 18 to be compressed as orbiting 12 is caused to orbit by the crank.

Figure 2:
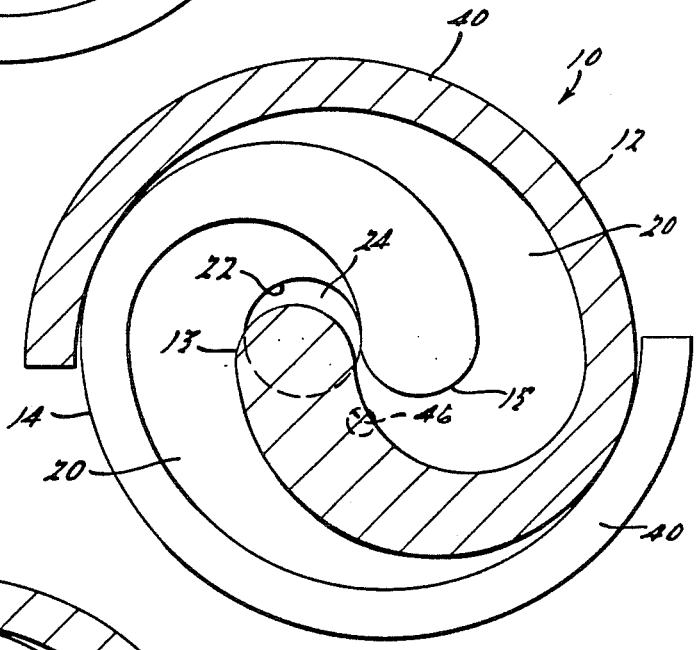
FIG. 2 is a diagrammatic illustration of a pair of mating scroll wraps constructed in accordance with the present invention at approximately 20 degrees of crank revolution.
Figure 3:
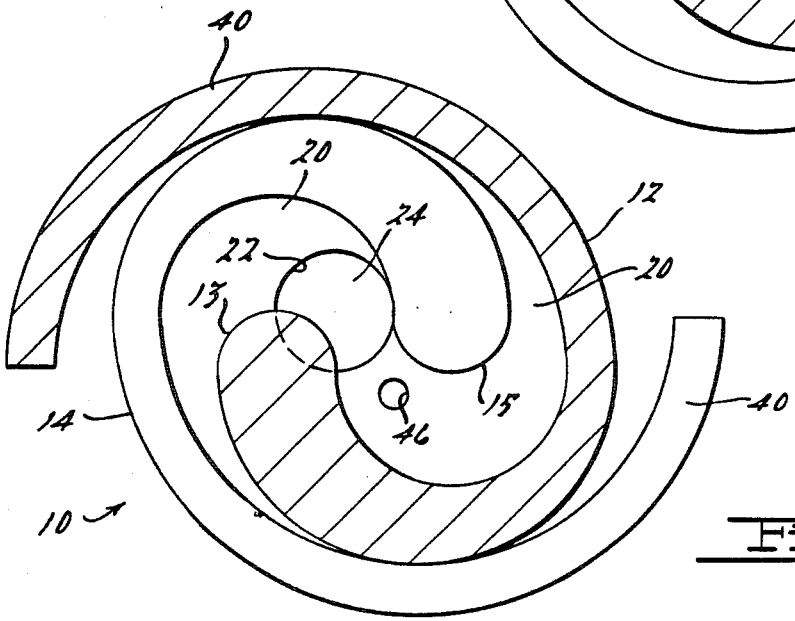
FIG. 3 is a diagrammatic illustration of a pair of mating scroll wraps constructed in accordance with the present invention at approximately 90 degrees of crank revolution.

Shortly after pockets 16 and 18 are formed, however, further crank revolution causes inner ends 13 and 15 of the orbiting and fixed scrolls to separate from the point of last sealing (i.e. lose their flank contact). When this happens, as shown in FIG. 2, pockets 16 and 18 merge and become single pocket 20 bounded by 2 lines of flank sealing contact. At the same time that single pocket 20 is formed, a discharge port 22 in the center of scroll apparatus 10 is exposed. As shown in FIGS. 1 through 5, inner ends 13 and 15 of orbiting and fixed scrolls 12 and 14 remain in sealing contact until virtually all of the compressed fluid of single pocket 20 is discharged through discharge port 22. In this manner, reexpansion volume is reduced to a minimum and compression losses are significantly reduced.

In a conventional scroll apparatus with a normally open discharge port, single pocket 20 would begin to discharge through the discharge port as soon as it was formed and complete the discharge during the remainder of the crank revolution with very little, if any, compression or volume reduction taking place. In such a case, scroll apparatus 10 would function as a volumetric device, i.e. simply moving fluids taken at inlet pressure into pockets 16, 18 and 20, through the discharge port 22, into a plenum and out through a discharge line (not shown) with virtually no precompression prior to discharge.

It has been discovered, however, that the benefits and characteristics of a scroll pump apparatus that moves a suction volume of fluid through the pump and discharges it in one crank revolution (as described above) can be translated directly into a compressor apparatus. In order to achieve volume reduction and hence compression with single pocket 20 prior to discharge, a discharge valve 24 is fitted into discharge port 22. Discharge valve 24 is designed to be normally closed and thus prevent any fluid movement therethrough until a desired discharge pressure is reached, at which point discharge valve 24 will open and single pocket 20 will be discharge through the discharge port 22. The use of discharge valve 24 enables scroll apparatus 10 to be applied to a variety of end uses which require different line pressures and hence different pressure ratios. Discharge valve 24 may be of any suitable type that is designed for one way operation. Discharge valves 24, then, open when line pressure is reached thereby creating in scroll apparatus 10 the flexibility of a range of pressure ratios without appreciably changing the overall size or performance of the apparatus by adding or subtracting scroll wraps. For instance, in an application requiring a given line pressure, discharge valve 24 of scroll apparatus 10 will open when sufficient precompression has taken place through a portion of the orbiting cycle to equal the line pressure. On the other hand, for an application requiring a significantly higher line pressure, discharge valve 24 of the same scroll apparatus 10 will not open to discharge until substantially more precompression has been achieved through a larger portion of the orbiting cycle, thereby equaling the higher line pressure.

The use of a disc-like valve, e.g. the type disclosed in U.S. Pat. No. 4,368,755 (issued Jan. 18, 1983, for Valve Assembly) the disclosure of which is incorporated herein by reference, as discharge valve 24 would further improve the efficiency of the scroll apparatus 10 because such a valve leaves very little residual clearance volume (i.e. non-discharged volume) between the valve and inner wrap end 13 of orbiting scroll 12 that covers the valve during a portion of the scroll's orbit. Hence, such a valve would reduce the amount of compression work loss that results when the trapped residual gas is suddenly re-exposed to a lower pressure volume during a subsequent compression cycle. A disc-type valve is shown as discharge valve 24 in FIGS. 6 and 7.

Figure 8A:
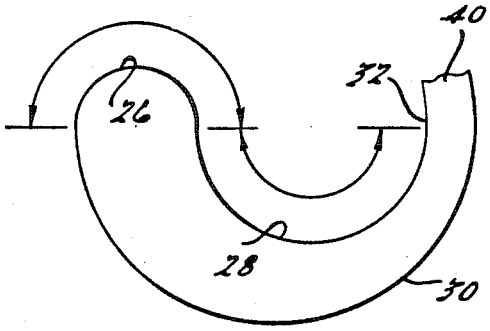
FIGS. 8A and 8B are enlarged diagrammatic illustrations of alternative embodiments of the inner end of a scroll wrap constructed in accordance with the present invention.

Orbiting and fixed scrolls 12 and 14 of scroll apparatus 10 can be machined using the general involute profile of a geometric figure, i.e. a square, triangle, line, circle, or any other suitable polygonal shape. As shown in FIG. 8A, however, the inner ends 13 and 15 of orbiting and fixed scrolls 12 and 14 of the present invention are modified to include at least one convex circular shape 26 and one concave circular shape 28 (for the case in which both scroll members have a constant angular relationship, as when, for instance, an oldham coupling is used; however, when there is slight relative angular movement between the scrolls, as in the case when an anti-rotational link is utilized, a further modification of this inner wrap end will have to be made accordingly to effect flank sealing). Circular shapes 26 and 28 link the remainder of an otherwise conventional scroll wrap of uniform width which comprises an outside wrap face 30 and an inside wrap face 32 which are both generally involute or curvilinear. Although faces 30 and 32 do not have to be circular, it is apparent from the description of the invention herein that it is a preferred embodiment. The special case in which the entire scroll member of scroll apparatus 10 is the involute of a straight line will be discussed below.

Figure 8B:
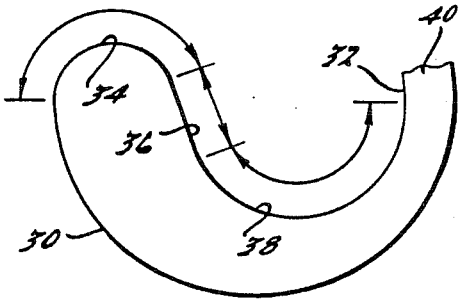

As an alternative embodiment shown in FIG. 8B, the inner ends 13 and 15 of orbiting and fixed scrolls 12 and 14 may also comprise one convex circular zone 34, one flat segment 36, and one concave circular zone 38 to link outer and inner wrap faces 30 and 32 of the orbiting and fixed scrolls. In the typical case, though, the embodiment shown in FIG. 8A is preferred because it permits the radii of circular shapes 26 and 28 to be maximized.

In accordance with the present invention the modified shapes of inner ends 13 and 15 of orbiting and fixed scrolls 12 and 14 are symmetrical in the preferred embodiment shown in FIGS. 1 through 5. However, these modified inner wrap ends 13 and 15 may also be nonsymmetrical provided that the radius of concave circular shape 28 of one scroll and the radius of convex circular shape 26 of the mating scroll have a difference that is equivalent to the orbiting radius of the mating scroll member. This difference in radii is necessary in order to effect flank sealing between inner end wraps 13 and 15.

In the preferred embodiment the wraps of orbiting and fixed scrolls 12 and 14 have a uniform width portion 40 that begins after concave circular shape 28 terminates away from inner ends 13 and 15 and continues to the outer end of the wrap. The length of uniform portion 40 is defined by the amount of wrap necessary to provide outer sealing or closure of pockets 16 and 18 simultaneously with or just before the crank angle at which inner wrap ends 13 and 15 of orbiting and fixed scrolls 12 and 14 separate from the final sealing point (usually about one half of a wrap, i.e. 180 degrees of uniform thickness). The length of uniform portion 40 may be increased to provide additional continuity in contact between the orbiting and fixed scroll wrap surfaces which will result in slight precompression prior to exposing the gas to the discharge valve. It has been found that lengthening uniform thickness portion 40 of the scroll wraps by approximately 5 degrees over the minimum amount required to provide the necessary closure will reduce the noise and wear on the wraps at closure. One advantage of the scroll apparatus of the present invention is the provision of a compressor with the benefits and characteristics of a conventional multi-wrap scroll compressor without its associated large potential leakage paths.

Figure 10:
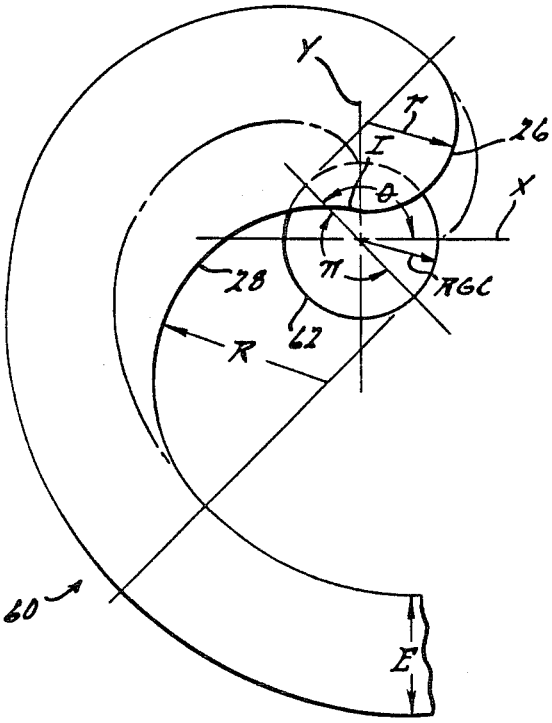
FIG. 10 is a diagram of the geometry of the present invention showing the nomenclature used.

With reference to FIG. 10, a modified inner wrap end 60 of an orbiting or fixed scroll generated from a circle 62 is shown. The equations that describe the modified involute profiles or the inner wrap end 60 of FIG. 10 when the relative motion is curvilinear translation and the relative rotational displacement between generating (x-y) axis of the scroll members is 180 degrees, are:

$$r=RGC(4\theta^2-Z^2+4)/4(2\theta+Z)$$

and $$\begin{aligned} R &= r+ROR \\ &= RGC\,(4\theta^2+8Z\theta+3Z^2+4)/4(2\theta+Z) \end{aligned}$$

Where:
r=convex shape radius
R=concave shape radius
RGC=radius of the generating circle
$\theta$=separation angle (minimum angle from the X-axis to a line that passes through the center of the generating circle and is perpendicular to a second line that is tangent to the generating circle and passes through the last point on the involute scroll wrap at which flank contact formerly occurred)
Z=Pi−X (wrap mating surface phase angle)
X=E/RGC (outside/inside wrap surface phase angle)
ROR=radius of orbit of orbiting scroll ($ROR=Z\,RGC$; $ROR=R-r$)
E=wrap thickness The scroll member of FIG. 10, a particular case of the above general description, is considered optimum because it is configured to mate with a symmetrical scroll member. Further optimization of the present invention occurs when the radius r of convex circular shape 26 is half of the radius R of concave circular shape 28, i.e. $r=R/2$. This relationship between convex and concave shape radii enables the diameter of discharge port 22 (not shown) to be maximized. The larger the discharge port the smaller the pressure pulsations and attendant noise (i.e. throttling losses upon discharge of the compressor fluid). The resultant maximum discharge port radius is equal to the radius r of convex circular shape 26.

The location of discharge port 22 is ideally tangent to the inflection point between convex shape 26 and concave shape 28 (i.e. point of curvature change which also is the point of last sealing). In FIG. 10, this inflection point is shown as point I. The location of Point I along the convex/concave shapes is also determined by connecting radii r and R with a straight line; Point I is located where the straight line intersects the convex/-concave shapes. In this location even when the size of discharge port 22 is maximized, coverage of discharge port 22 by inner end 13 of orbiting scroll 12 at the point that fluid pockets 16 and 18 are formed is substantially effected as shown in FIGS. 1 through 5, thereby preventing compression loss. In this preferred location discharge port 22 is also partially exposed to single pocket 2 at the point that the inner wrap ends of orbiting and fixed scrolls 12 and 14 separate to form single pocket 20. For the embodiment shown in FIG. 8B comprising flat segment 36 between convex and concave circular zones 34 and 38, discharge port 22 is ideally located along flat segment 36 (which is a segment of last sealing for this embodiment).

Figure 11:
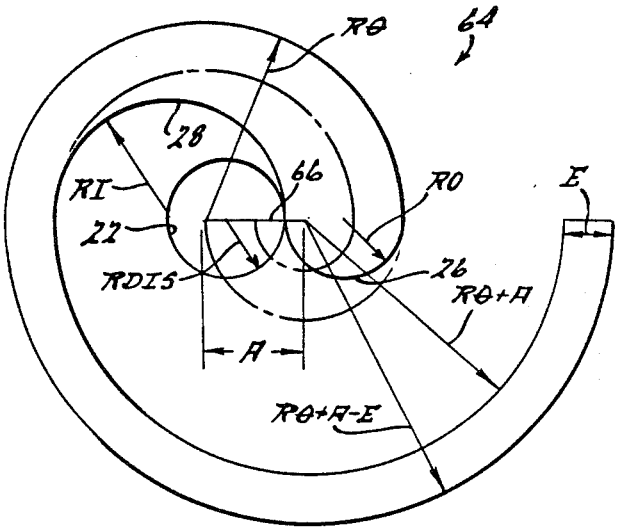
FIG. 11 is a diagrammatic illustration of an alternative embodiment of a symmetrical scroll wrap in accordance with the present invention also showing the geometry and nomenclature used.

An alternative embodiment of the general scroll apparatus design of the present invention set forth above involves generating orbiting and fixed scrolls 12 and 14 from the involute profile of a line segment. It is known that the involute of a line segment can present advantages in fabrication as the individual scroll members are comprised entirely of circular arcs of varying radii. FIG. 11 illustrates a scroll member 64 of the present invention wnich has its contoured surfaces generated by the involute of a line segment 66. Like the scroll member shown in FIG. 10, scroll member 64 of FIG. 11 is also optimized in its configuration, i.e. scroll member 64 is configured to mate with a symmetrical scroll member. Furthermore, to maximize the radius of discharge port 22 as explained above, the radius RO of convex circular shape 26 is half of the radius RI of concave circular shape 28, i.e. $RO=RI/2$. The resultant radius of discharge port 22 for scroll member 64 is therefore equal to the radius RO of convex shape 26. The following terminology and relationships apply for scroll member 64 of the present invention that is created from the involute of a line segment:
RO=convex shape radius (inches)
RI=concave shape radius (inches)
ROR=orbiting radius of orbiting scroll (inches)
A=length of generating line segment (inches)
R$\theta$=initial radius (inches)
E=thickness of wrap (inches)
H=height of wrap (inches)
RDIS=discharge port radius (inches)
D=displacement (cubic inches per revolution)

$$RI-RO=ROR \text{ or } RI=ROR+RO$$

$$2R\theta-E-2RO=2RI$$

$$2(R\theta+A)-2R\theta-E=2ROR+E$$

thus, $$ROR=A-E$$

$$RI=+A-E$$

$$R\theta=2RO+A-E/2$$

$$D=Pi[(R\theta+A-E)^2-R\theta+RI^2-RO^2]H$$

and after simplifications, $$D=PiHROR(3R\theta+ROR-E/2)$$

For the particular case in FIG. 11 where $RO=-RI/2=RDIS$:

$$RO=RI/2=A-E=ROR$$

$$R\theta=3A-5/2E$$

$$D=PiH(A-E)(10A-9E)$$

The inner and outer flanks of a pair of mating scroll members 64 of the present invention as shown in FIG. 11 can be machined on a specially designed milling machine fixture 48. Fixture 48, which is schematically depicted in FIGS. 13A through 13L, has a base 49, a head 50 which rotates on a horizontal axis within a housing 51 as shown, a slide mechanism 52 disposed in an opening 59 in head 50, a plurality of index points 53 and index pins 58 carried on slide mechanism 52 and rotating head 50 for positioning the slide relative to the head, and a pair of locaters 55 and locating pins 57 carried on head 50 and housing 51 for limiting the incremental rotation of head 50 within housing 51. The milling machine preferably has a pair of axially aligned fixed end mills 54 disposed on opposite sides of rotating head 50. The common axis of end mills 54 is fixed with respect to base 49.

It has been discovered that because scroll member 64 of FIG. 11 is comprised of 180 degree circular arcs of varying radii (even after the inner end of the wrap is modified in accordance with the present invention) there is a very simple technique which may be used for simultaneously machining the inner and outer flanks of a pair of symmetrical scroll members.

FIGS. 13A through 13L show various stages of a scroll member, whose profile is the involute of a line segment, being machined in fixture 48. Initially a reference point must be determined for locating workpieces 56 relative to tools 54. The location of this reference point is based on the generating line segment being specifically located so that workpieces 56 will accommodate the entire finished involute profile. One location of this reference point is the middle of the generating line segment which, during rotation of head 50, will always remain at the same altitude.

Figure 13A:
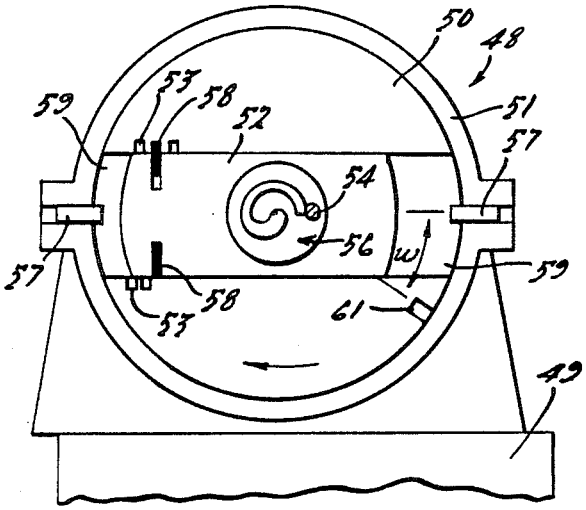
FIGS. 13A through 13L are schematic elevation and overhead views of an apparatus which can be used to practice the machining method of the present invention.
Figure 13B:
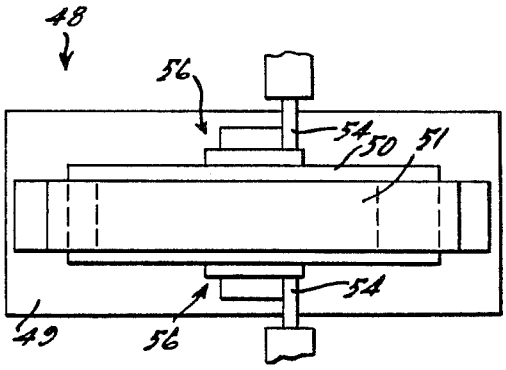
Figure 13C:
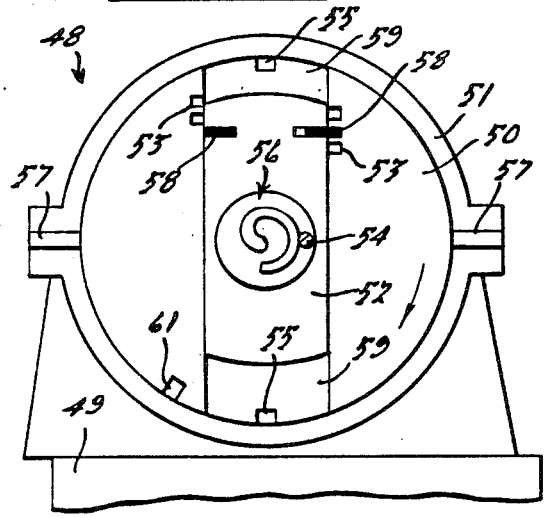

After the reference point is determined, workpieces 56 are symmetrically positioned in a clamping means on each side of slide mechanism 52 relative to tools 54 as shown in FIG. 13A and locked in a position so that the reference point is aligned with the altitude of the axis of tools 54. Locating pins 57 are then released and head 50 is rotated 180 degrees while tools 54 machine the first 180 degree portion of the outside flank or face of the desired involute profile on workpieces 56 (i.e. half of a wrap; see FIGS. 13C and 13D). After 180 degrees of rotation, locating pins 57 once again engage locaters 55. Since the first 180 degree portion of the outside flank typically is not a working surface, i.e. it does not make sealing contact with a complimentary scroll member in a scroll apparatus, it does not need to be finished. Such a surface alternately could be roughed in and the normal or finish machining process started with the next step described below.

Figure 13D:
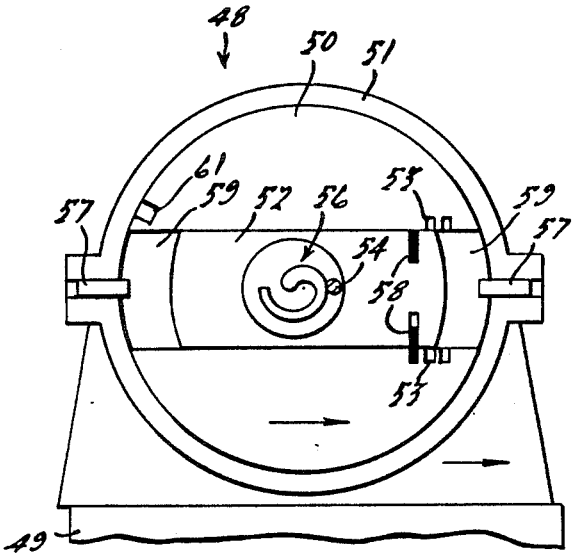
Figure 13E:
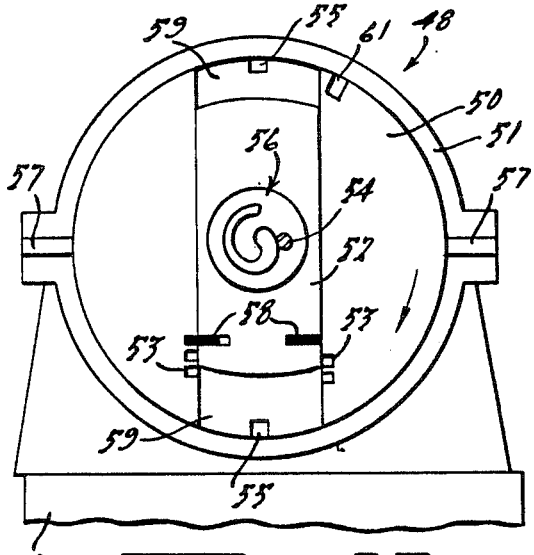
Figure 13F:
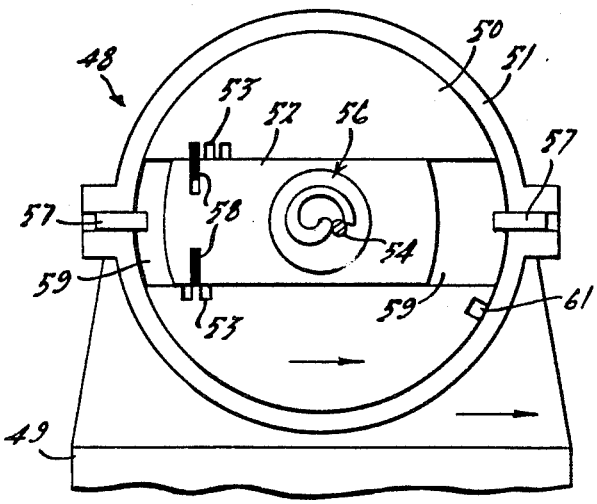
Figure 13G:
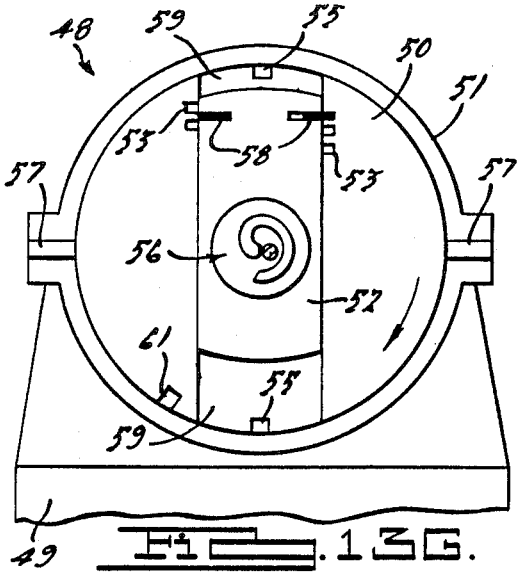

After the first 180 degree portion of the outer flank is machined, housing 51 and head 50 are indexed (moved laterally, after release of index pin 58, along base 49 as indicated by the arrow in FIG. 13D and held in place at a new index point 53 by index pin 58) a predetermined amount to coincide with the change in radius for the next 180 degree portion of involute profile, while slide mechanism 52 remains stationary with respect to base 49 and the axis of tools 54, thereby maintaining the position between tools 54 and workpieces 56. (While FIGS. 13A and 13C through 13L depict a fully machined involute profile on workpieces 56 for illustrative purposes, in actuality 180 degree portions of each involute flank are consecutively machined.) After the indexing step, locating pins 57 are released and head 50 is rotated another 180 degrees in the same direction, as shown in FIGS. 13E and 13F and tools 54 cut the next consecutive 180 degree portion of the same flank of the desired involute profile of scroll member 64.

When locating pins 57 again engage locaters 55, the step of laterally shifting housing 51 and head 50 along base 49 (the proper amount being predetermined by index points 53 and index pins 58) is repeated as shown in FIG. 13F. Locating pins 57 are then released and head 50 is again rotated in the same direction 180 degrees to machine the inner end portion (convex circular shape) of scroll member 64 that is defined by radius r (see FIGS. 13G and 13H).

Figure 13H:
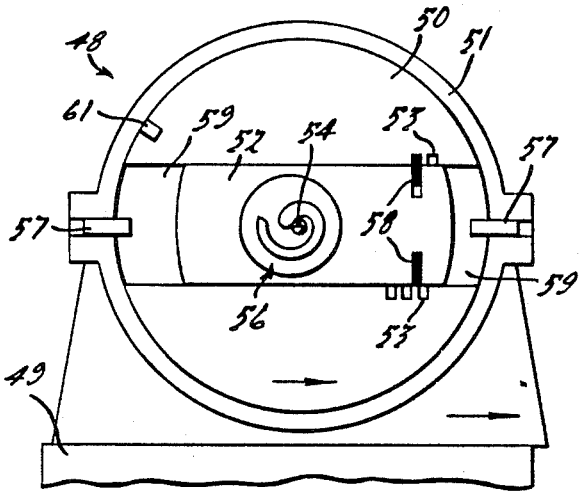
Figure 13I:
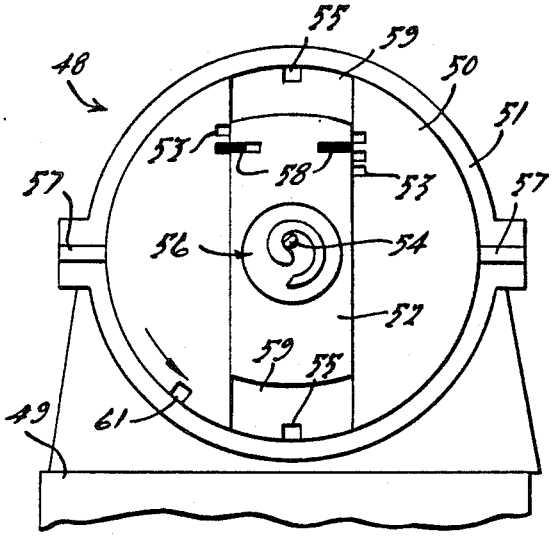

After locating pins 57 are once again engaged in locaters 55, housing 51 and head 50 are indexed for a third time along base 49 as shown in FIG. 13H. Locating pins 57 are released and head 50 is then rotated 180 degrees in the reverse direction as shown by the arrow in FIG. 13I to machine the 180 degree portion of the inside flank of scroll members 64 that corresponds to concave circular shape 28 with radius R.

Figure 13J:
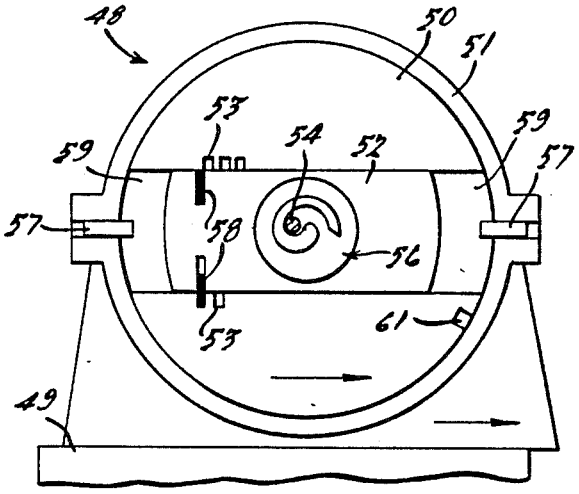
Figure 13K:
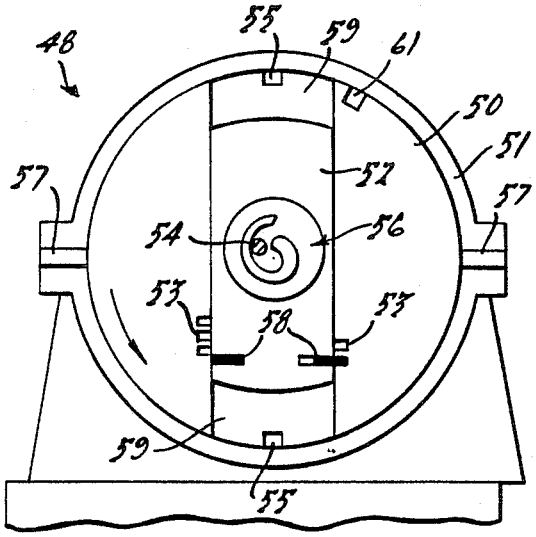

Subsequently, as shown in FIG. 13J, locating pins 57 engage locaters 55 and housing 51 and head 50 are indexed a fourth time in the same direction along base 49. Then locating pins 57 are once again released and head 50, as shown in FIG. 13K, is rotated in the same reverse direction to machine the final portion of the inside flank of scroll members 64.

Figure 15:
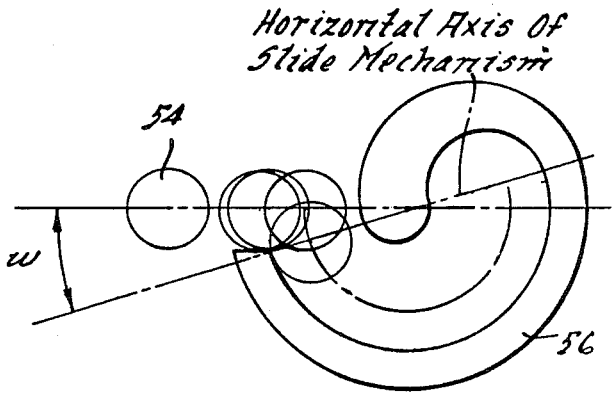
FIG. 15 is a diagrammatic illustration of the additional machining angle utilized in the machining method of the present invention to complete the scroll members and remove the cutting tools.
Figure 13L:
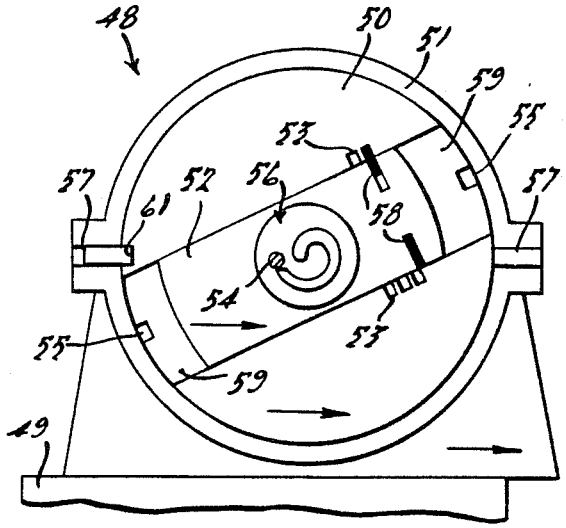

The final rotation of head 51 described immediately above is greater than 180 degrees. As shown in FIG. 13L the rotation of head 51 continues beyond 180 degrees until a finishing locater 61 reaches locating pin 57. After locating pin 57 engages locater 61, housing 51 and head 50 are indexed a final time in the same direction along base 49. During this final indexing, however, slide mechanism 52 is shifted along with housing 51 and head 50 and does not remain stationary with base 49. This additional machining rotation or angle is necessary along with the final indexing to terminate the wrap of scroll members 64 after a full 360 degrees of wrap angle is completed and to allow tools 54 to clear the wrap when removing workpieces 56. FIGS. 13L and 15 illustrate the additional necessary machining angle W (i.e. increment of rotation in addition to 180 degrees) which is defined by the equation:

$$W = \text{arc sin}\left[\frac{d}{2(R\theta + A - E)}\right]$$

Where d=diameter of tools 54
R$\theta$=initial radius
A=length of generating line segment
E=thickness of wrap If desired, the machining method disclosed and fixture 48 could be utilized to simultaneously machine involute profiles (generated from a line segment) of substantially more than one wrap for a pair of scroll members. In such an embodiment the number of 180 degree wrap segments determines the number of shifting steps which in turn determines the number of index points 53 and index pins 58 required to complete the scroll members.

A pair of symmetrical scroll members may be simultaneously machined because the concept of symmetrical involute scroll profiles provides flank sealing when the relative motion between the scrolls is curvilinear translation and the relative rotational displacement between the generating (X-Y) axis of the scroll members is 180 degrees. The scroll members are hence mirror images of one another and when a dual spindle is used as on fixture 48, a matching set of scroll members can be machined for use as a fixed and an orbiting scroll, thus significatly reducing the cost of manufacturing the scroll apparatus. Inasmuch as the inside and outside flanks of a pair of symmetrical scroll members 64 are simultaneously machined on fixture 48 in one setup, it is important to have a flat and consistent base surface. Any imperfections that do however occur on one scroll wrap member in the machining process should correspond to like imperfections on the other scroll wrap member and therefore negate any adverse effects.

Figure 9A:
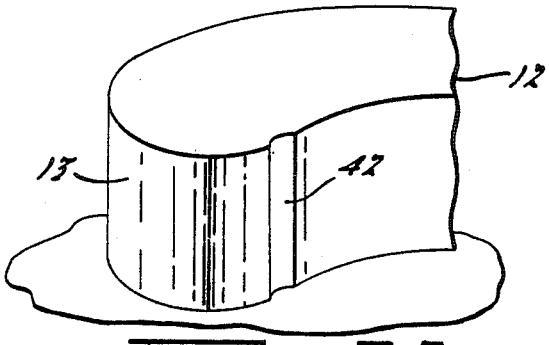
FIGS. 9A and 9B are enlarged diagrammatic illustrations of a further modification of the inner wrap end of the scroll member of the present invention.
Figure 9B:
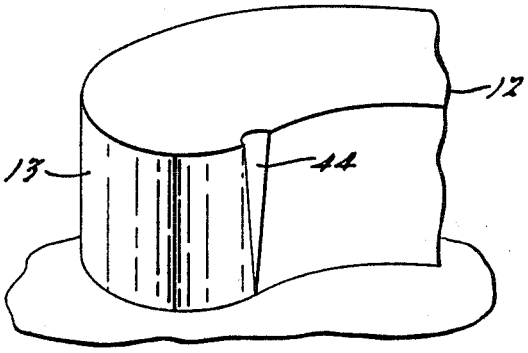

The inner wrap end 13 of orbiting scroll 12 may be modified with a cylindrical cutout section 42 as shown in FIG. 9A. Cutout section 42 reduces discharge flow restriction that is inherent with the constantly decreasing cross sectional area of single pocket 20 near the end of the compression/discharge discharge cycle and substantially eliminates any pressure peak noises caused by such restriction. In FIG. 9B, a conically shaped cutout section 44 is shown that achieves the same purpose of cutout section 42 and further serves to reduce reexpansion volume by decreasing the amount of undischarged fluid that can be trapped in the cutout section. The alternative modifications of cutout sections 42 or 44 may also be made on inner wrap end 15 of fixed scroll 14. However, if conical cutout section 44 is used, it is preferably located on orbiting scroll 12 as it would be less difficult to machine. The small amount of clearance volume that is introduced into the compression cycle through use of cutout section 42 or 44 should not appreciably affect the performance of the scroll apparatus. Both cutout sections 42 and 44 are preferably located at the point of curvature change between the concave and convex circular shapes or zones of the inner wrap ends of the particular scroll member.

As shown in FIGS. 1 through 5, the shape of the inner ends 13 and 15 of the scroll wraps of scroll apparatus 10 enable a liquid or vapor injection port 46 to be provided similar to liquid injection systems that are implemented in rotary devices. Injection port 46 is naturally opened and closed by inner end 13 of orbiting scroll 12 as it proceeds in its orbit. The location of injection port 46 is predetermined to enable port 46 to open (and close) at the desired pressure or volume ratio of the sealed pocket at which liquid or vapor injection is (or is not) to take place.

When an anti-rotation device of the Oldham coupling type or the like is used in scroll apparatus 10, the direction of the translatory motion of the coupling device is preferably situated to be substantially perpendicular to the line joining the centers of the wrap termination radii. For example, in the case of an involute profile generated from a line segment, the translatory motion of the coupling device should be oriented perpendicular to the line segment itself. In this manner, the effect of the coupling device's added inertial force on flank friction between the scroll members is minimized. This is especially effective when the drive mechanism of scroll apparatus 10 incorporates a degree of free movement in the radial direction.

The scroll apparatus of the present invention possesses many advantages over prior known scroll compressors comprising multiple involutewraps. Utilizing scroll members of approximately a single wrap, scroll apparatus 10 provides a very compact compressor design that enhances its manufacturability. Scroll apparatus 10 is very versatile because, in addition to being much smaller in diameter and hence weight as compared to conventional scroll compressors, the same apparatus 10 is also more adaptable at delivering fluid gas at various pressure ratios. Due to the decreased scroll diameters, scroll apparatus 10 also experiences less radially offset axial loading due to the scroll member separating pressure force associated with multiple fluid pockets of multi-wrap scroll compressors. The large displacement per unit of overall compressor diameter of scroll apparatus 10 results in a decreased load on the conventional type thrust bearing that is used in the scroll apparatus.

Scroll apparatus 10 is not a fixed pressure ratio machine as are conventional multiwrap scroll compressors. The scroll apparatus of the present invention possesses many of the advantages of a reciprocating piston compressor. For example, the compression phase of scroll apparatus 10 starts essentially from suction and delivers gaseous fluid substantially at discharge line pressure in a single crank revolution. Scroll apparatus 10 further possesses many of the advantageous features of a rotary or standing vane (rolling piston) compressor. For example, during a single crank revolution scroll apparatus 10 compresses one volume of gaseous fluid to discharge pressure while the suction phase is occurring in two other volumes.

Scroll compressor 10 also has the pressure ratio versatility of piston and rotary type machines because there is no undercompression or overcompression work loss. Scroll apparatus 10 simply takes gas at suction volume pressure and delivers it at discharge line pressure.

Figure 12:
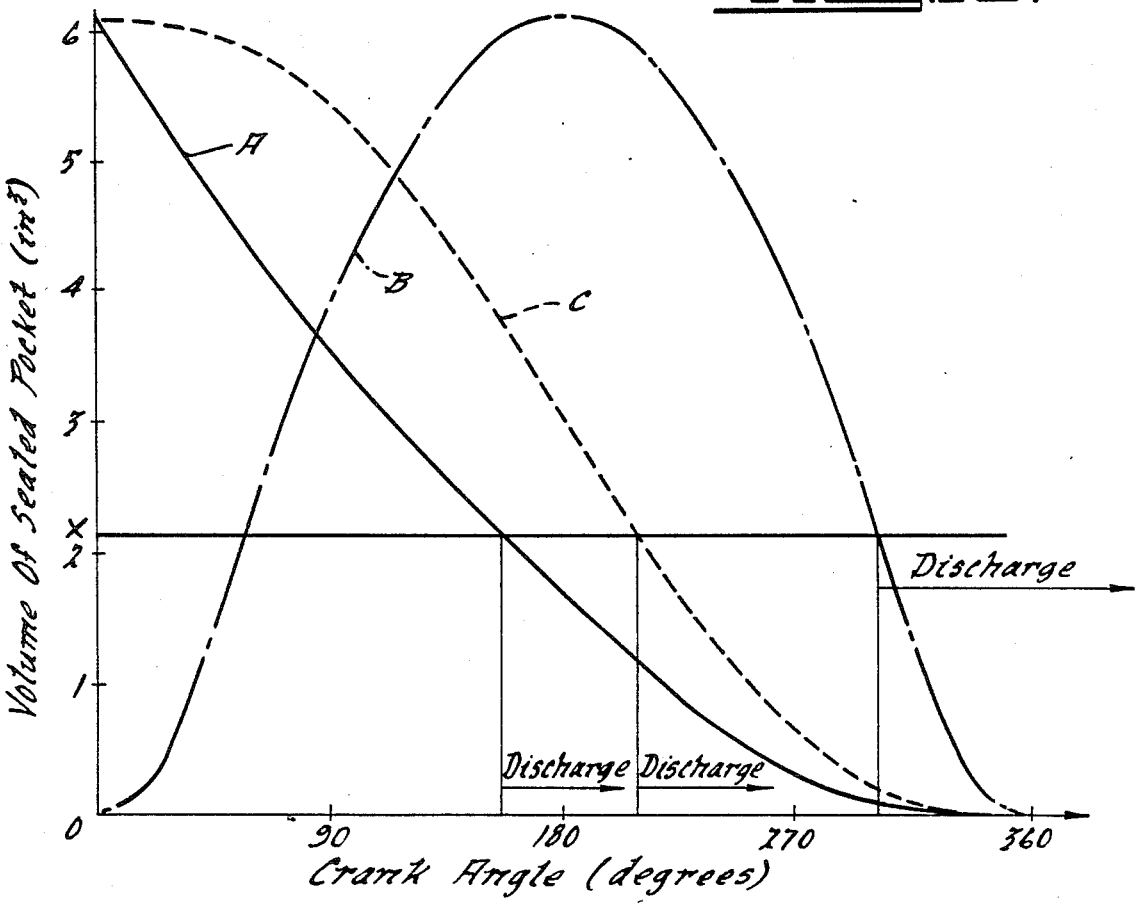
FIG. 12 is a graphic illustration of volume of compressed gas per crank angle in a reciprocating piston compressor, a rotary piston compressor, and a scroll compressor embodying the principles of the present invention.

The efficiency of the scroll apparatus of the present invention is improved, however, over reciprocating piston and rotary type compressors. FIG. 12 compares the volume of compressed gas per crank angle of a reciprocating piston compressor, a rotary compressor, and a scroll compressor of the present invention. As shown in FIG. 12, scroll apparatus 10 (see curve A) reaches a desired level of compression and hence discharge pressure (point X) much sooner in the course of a single crank revolution than either an equivalent reciprocating piston compressor (shown as curve B) or an equivalent rotary compressor (shown as curve C). The increased compression per crank angle of scroll apparatus 10 (and hence attendant longer discharge time per crank revolution enables scroll compressors of the present invention to be operated at higher speeds and with an improved level of efficiency than such other types of conventional compressors.

A further advantage of the scroll apparatus of the present invention resides in the modified inner wrap ends of the orbiting and fixed scrolls. Besides being thicker and therefore stronger and allowing for increased sealing area on the inner ends of the wrap, the modified ends greatly reduce the amount of residual volume (i.e. amount of final compressed gas volume that is not discharged) that is inherently present in conventional scroll compressor devices and that leads to inefficiencies as previously explained. In the case of scroll apparatus 10, this potential loss or efficiency is critical as any reexpansion volume that is present is communicated directly with a newly closed volume that is essentially at suction pressure. The modified inner ends of the scroll wrap of the present invention virtually eliminate any reexpansion volume and associated work loss by providing continuous sealing up to the end of the compression/discharge cycle.

Thus, there is described and shown in the above description, background and drawings an improved scroll-type machine which fully and effectively accomplishes the objectives thereof. However, it will be apparent that variations and modifications of the disclosed embodiment may be made without departing from the principles of the invention or the scope of the appended claims.

It is claimed:

1. A scroll-type apparatus comprising:

a fixed scroll member having a first spiral wrap; and a second scroll member having a second spiral wrap, said first and second spiral wraps each having an inner end and an outer end, said second scroll member being mounted for movement along a predetermined cyclical path with respect to said first scroll member, said second wrap being intermeshed with said first wrap so that when said second scroll member is moved with respect to said first scroll member at least one fluid pocket is formed which carries fluid from a peripherally located inlet of said apparatus to a centrally located outlet of said apparatus, said first and second spiral wraps having a wrap length such that a minimum of two and a maximum of three line contacts between said wraps occur during a full cycle of said movement of said second scroll member, said first and second spiral wraps each having an inner end comprised of a concave arcuate shape and a convex arcuate shape, said arcuate shapes being configured to reduce the volume of said fluid pocket to a theoretical zero volume just prior to separation of said wraps, said wraps differing from said configuration by the provision of a cutout section in one of said wraps defining a relatively shallow recess in the flank surface of said one of said spiral wraps adjacent the inner end thereof and formed substantially along the entire height of said wrap so as to insure provision of a flowpath of minimum volume communicating between said fluid pocket and said outlet as said fluid pocket is reduced in volume.

2. A scroll-type apparatus as described in claim 1, further comprising a discharge valve located in said outlet, said discharge valve being designed to permit flow of fluid through said outlet to a discharge line when the pressure in said fluid pocket exceeds the pressure of said discharge line.

3. A scroll-type apparatus as described in claim 1 wherein said concave circular shape is adjacent to said convex circular shape.

4. A scroll-type apparatus as describe in claim 3, wherein said convex circular shape has a radius r defines as:

$$r=RGC(4\theta^2-Z^2+4)/4(2\theta+Z)$$

and said concave circular shape has a radius R defined as:

$$R=r+ROR=RGC(4\theta^2+8Z^2+4)/4(2\theta+Z)$$

where

E=wrap thickness

ROR=radius of orbital movement of said second scroll member

RGC=radius of the said circle $\theta$=separation angle $$Z=Pi-X$$

$$X=E/RGC.$$

5. A scroll-type apparatus as described in claim 1 further comprising a straight section of wrap disposed between said concave and said convex circular shapes.

6. A scroll-type apparatus as described in claim 1, wherein said first and second spiral wraps have profiles extending outwardly from said concave and convex circular shapes which are involutes of a circle.

7. A scroll-type apparatus as described in claim 2, wherein said first and second spiral wraps have profiles which are involutes of a straight line.

8. A scroll-type apparatus as described in claim 4, wherein said convex circular shape has a radius that is one half the radius of said concave circular shape.

9. A scroll-type apparatus as described in claim 8, wherein the radius of said outlet is substantially equivalent to the radius of said convex circular shape.

10. A scroll-type apparatus as described in claim 8, wherein said outlet is located tangent to said first spiral wrap substantially at the point of inflection between said convex and said concave circular shapes.

11. A scroll-type apparatus as described in claim 2, wherein said first scroll member has an end plate and a fluid injection port that is located in said end plate, said fluid injection port being opened and closed by movement of said second scroll member along said predetermined path with respect to said first scroll member.

12. A scroll-type apparatus as described in claim 2, wherein said cutout section is cylindrical in configuration.

13. A scroll-type apparatus comprising:

a fixed scroll member having a first spiral wrap; and a second scroll member having a second spiral wrap, said first and second spiral wraps each having an inner end and an outer end, said second scroll member being mounted for movement along a predetermined cyclical path with respect to said first scroll member, said second wrap being intermeshed with said first wrap so that when said second scroll member is moved with respect to said first scroll member at least one fluid pocket is formed which carries fluid from a peripherally located inlet of said apparatus to a centrally located outlet of said apparatus, said first and second spiral wraps having a wrap length such that a minimum of two and a maximum of three line contacts between said wraps occur during a full cycle of said movement of said second scroll member, said first and second spiral wraps each having an inner end comprised of a concave arcuate shape and a convex arcuate shape, said arcuate shapes being configured to reduce the volume of said fluid pocket to a theoretical zero volume immediately prior to separation of said wraps, said wraps differing from said configuration by the provision of a conical cutout section on one of said spiral wraps adjacent said outlet and formed substantially along the entire height of said wrap, said conical cutout section being oriented to converge toward said outlet.

14. A scroll-type apparatus comprising:

a fixed scroll member having a first spiral wrap;

a second scroll member having a second spiral wrap; said first and second spiral wraps each having an inner end and an outer end, said second scroll member being mounted for movement along a predetermined cyclical path with respect to said first scroll member, said second wrap being intermeshed with said first wrap so that when said second scroll member is moved with respect to said first scroll member at least one fluid pocket is formed which carries fluid from a peripherally located inlet of said apparatus to a centrally located outlet of said apparatus, said first and second spiral wraps each having a wrap length such that a minimum of two and a maximum of three contacts between said wraps occur during a full cycle of said movement of said second scroll member; and a discharge valve located in said outlet, said discharge valve being designed to permit the flow of fluid through said outlet to a discharge line when the pressure in said fluid pocket exceeds the pressure of said discharge line;

said first and second spiral wraps being symmetrical in configuration and said inner ends comprising a convex arcuate shape and an adjacent concave arcuate shape;

wherein said wraps form first and second moving contacts which move progressively toward each other during movement of said second scroll member, said arcuate shapes being configured to reduce the volume of said fluid pocket to a theoretical zero volume just prior to separation of said wraps, said wraps differing from said configuration by the provision of a cutout section in one of said wraps defining a recess in the flank surface of said one of said spiral wraps adjacent the inner end thereof and formed substantially along the entire height of said wrap, said recess insuring a flowpath between said fluid pocket and said outlet as said first and second moving contacts merge into a single line contact.

15. A scroll-type apparatus as described in claim 14, further comprising a straight section of wrap disposed between said concave and said convex circular shapes.

16. A scroll-type apparatus as described in claim 14, wherein said first and second spiral wraps have profiles radially outward from said concave and convex circular shapes which are involutes of a circle.

17. A scroll-type apparatus as described in claim 14, wherein said first and second spiral wraps are involutes of a straight line.

18. A scroll-type apparatus as described in claim 14, wherein said outlet is located in an end plate of said first scroll member and said discharge valve is a disc-like valve that is located in and substantially flush with said end plate.

19. A scroll-type apparatus as described in claim 14, wherein said outlet is located tangent to said first spiral wrap substantially at the point of inflection between said convex and said concave circular shapes.

20. A scroll-type apparatus as described in claim 14, wherein said cutout section is cylindrical in configuration.

21. A scroll-type apparatus as described in claim 14, wherein said first scroll member has an end plate and a fluid injection port that is located in said end plate, said fluid injection port being opened and closed by curvilinear movement of said second scroll member.

22. A scroll-type apparatus as described in claim 14, wherein said convex circular shape has a radius r defined as:

$$r=RGC(4\theta^2-Z^2+4)/4(2\theta+Z)$$

and said concave circular shape has a radius R defined as:

$$R=r+ROR=RGC(4\theta^2+8Z\theta-3Z^2+4)/4(2\theta+Z)$$

where

E = wrap thickness

ROR = radius of orbital movement of said second scroll member.

RGC = radius of the said circle $\theta$ = separation angle $$Z=Pi-X$$

$$X=E/RGC.$$

23. A scroll-type apparatus as described in claim 22, werein said convex circular shape has a radius that is one half the radius of said concave circular shape.

24. A scroll-type apparatus as described in claim 23, wherein the radius of said outlet is substantially equivalent to the radius of said convex circular shape.

25. A scroll-type apparatus comprising:

a fixed scroll member having a first spiral wrap;

a second scroll member having a second spiral wrap; said first and second spiral wraps each having an inner end and an outer end, said second scroll member being mounted for movement along a predetermined cyclical path with respect to said first scroll member, said second wrap being intermeshed with said first wrap so that when said second scroll member is moved with respect to said first scroll member at least one fluid pocket is formed which carries fluid from a peripherally located inlet of said apparatus to a centrally located outlet of said apparatus, said first and second spiral wraps being involutes of a straight line and having a wrap length such that a minimum of two and a maximum of three contacts between said wraps occur during a full cycle of said movement of said second scroll member; and a discharge valve located in said outlet, said discharge valve being designed to permit the flow of fluid through said outlet to a discharge line when the pressure in said fluid pocket exceeds the pressure of said discharge line;

said first and second spiral wraps being symmetrical in configuration and said inner ends comprising a convex circular shape and an adjacent concave circular shape, said convex circular shape having a radius RO defined as:

$$RO = \frac{RO - A + E/2}{2}$$

and said concave circular shape having a radius RI defined as:

$$RI = ROR + RO$$

where

ROR = radius of orbital movement of said second scroll member

A = length of said straight line

R$\theta$ = initial radius

E = thickness of wrap wherein said wraps form first and second moving contacts which move progressively toward each other during movement of said second scroll member until said first and second contacts merge to a single contact whereby substantially all of said fluid is discharged through said outlet and said outer ends of said first and second wraps form a second and third moving line contact thereby creating a new pair of fluid pockets, said single contact subsequently terminating and causing said pair of fluid pockets to become a single fluid pocket and wherein one of said spiral wraps include a cutout section adjacent said outlet and formed substantially along the entire height of said wrap.

26. A scroll-type apparatus as described in claim 25, wherein said convex circular shape has a radius that is one half the radius of said concave circular shape.

27. A scroll-type apparatus as described in claim 26, wherein the radius of said outlet is substantially equivalent to the radius of said convex circular shape.

28. A scroll-type apparatus comprising:

a fixed scroll member having a first spiral wrap;

a second scroll member having a second spiral wrap; said first and second spiral wraps each having an inner end and an outer end, said second scroll member being mounted for movement along a predetermined cyclical path with respect to said first scroll member, said second wrap being intermeshed with said first wrap so that when said second scroll member is moved with respect to said first scroll member at least one fluid pocket is formed which carries fluid from a peripherally located inlet of said apparatus to a centrally located outlet of said apparatus, said first and second spiral wraps having a wrap length such that a minimum of two and a maximum of three contacts between said wraps occur during a full cycle of said movement of said second scroll member; and a discharge valve located in said outlet, said discharge valve being designed to permit the flow of fluid through said outlet to a discharge line when the pressure in said fluid pocket exceeds the pressure of said discharge line;

said first and second spiral wraps being symmetrical in configuration and said inner ends comprising a convex arcuate shape and an adjacent concave arcuate shape;

wherein said wraps form first and second moving contacts which move progressively toward each other during movement of said second scroll member until said first and second contacts merge to a single contact whereby substantially all of said fluid is discharged through said outlet and said outer ends of said first and second wraps form a second and third moving line contact thereby creating a new pair of fluid pockets, said single contact subsequently terminating and causing said pair of fluid pockets to become a single fluid pocket and wherein one of said spiral wraps includes a conical cutout section adjacent said outlet and formed substantially along the entire height of said wrap, said conical cutout section being oriented to converge toward said outlet.

* * * * *

UNITED STATES PATENT AND TRADEMARK OFFICE

CERTIFICATE OF CORRECTION

PATENT NO. : 4,781,549

DATED : November 1, 1988

INVENTOR(S) : Jean-Luc Caillat

It is certified that error appears in the above-identified patent and that said Letters Patent is hereby corrected as shown below:

Column 1, line 46, "symmtrical" should be -- symmetrical --.

Column 1, line 51, "resect" should be -- respect --.

Column 2, line 33, "relative" should be -- relatively --.

Column 2, line 35, "a" should be -- an --.

Column 3, line 12, "aproximately" should be -- approximately --.

Column 4, line 62, "nonexistant" should be -- nonexistent --.

Column 5, line 21, after "orbiting" insert -- scroll --.

Column 5, line 61, "discharge" (first occurrence) should be -- discharged --.

Column 8, line 21, "2" should be -- 20 --.

Column 8, line 36, "wnich" should be -- which --.

UNITED STATES PATENT AND TRADEMARK OFFICE

CERTIFICATE OF CORRECTION

PATENT NO. : 4,781,549

DATED : November 1, 1988

INVENTOR(S) : Jean-Luc Caillat

It is certified that error appears in the above-identified patent and that said Letters Patent is hereby corrected as shown below:

Column 9, line 5, "R$\theta$" (first occurrence) should be -- RO --.

Column 9, line 5, "R$\theta$" (second occurrence) should be -- R$\theta^2$ --.

Column 9, line 67, "complimentary" should be -- complementary --.

Column 10, line 50, "51" should be -- 50 --.

Column 10, line 52, "51" should be -- 50 --.

Column 11, line 29, "significatly" should be -- significantly --.

Column 12, line 21, "involutewraps" should be "involute wraps --.

Column 13, line 18, "or" should be -- of --.

Column 14, lines 9 and 10, "defines" should be -- defined --.

Column 14, line 17, Claim 4, "$(4\theta^2 + 8Z^2 + 4)$" should be -- $(4\theta^2 + 8Z\theta + 3Z^2 + 4)$ --.

UNITED STATES PATENT AND TRADEMARK OFFICE

CERTIFICATE OF CORRECTION

PATENT NO. : 4,781,549

DATED : November 1, 1988

INVENTOR(S) : Jean-Luc Caillat

It is certified that error appears in the above-identified patent and that said Letters Patent is hereby corrected as shown below:

Column 14, line 36, Claim 7, "2" should be -- 1 --.

Column 14, line 49, Claim 11, "2" should be -- 1 --.

Column 16, line 43, Claim 23, "werein" should be -- wherein --.

Column 17, line 36, Claim 25, "include" should be -- includes --.

Signed and Sealed this

Twenty-sixth Day of December, 1989

*Attest:*

JEFFREY M. SAMUELS

*Attesting Officer* *Acting Commissioner of Patents and Trademarks*